US005408398A

United States Patent [19]

Chang

[11] Patent Number: 5,408,398

[45] Date of Patent: Apr. 18, 1995

[54] REFLECTING BASE ASSEMBLY FOR PERFORMANCE STAGE LAMPS

[76] Inventor: Ming C. Chang, No. 10, Alley 48, Lane 5, Sheng Li St., Yung Kang Hsiang, Taipei Hsien, Taiwan, Prov. of China

[21] Appl. No.: 221,885

[22] Filed: Apr. 1, 1994

[51] Int. Cl.[6] ..... F21V 9/00

[52] U.S. Cl. ..... 362/293; 362/307; 362/346; 362/297; 362/284

[58] Field of Search ..... 362/293, 299, 300–301, 362/346, 297, 296, 328, 284, 307, 280, 319

[56] References Cited

U.S. PATENT DOCUMENTS

| | | | |
|---|---|---|---|
| 4,535,394 | 8/1985 | Dugre | 362/293 X |
| 4,620,791 | 11/1986 | Combastet | 362/293 |
| 4,931,916 | 6/1990 | Callahan | 362/284 |
| 5,180,222 | 1/1993 | Robinson | 362/298 |
| 5,333,102 | 7/1994 | Oberman et al. | 362/284 |

*Primary Examiner*—Ira S. Lazarus
*Assistant Examiner*—Thomas M. Sember
*Attorney, Agent, or Firm*—Hamilton, Brook, Smith & Reynolds

[57] ABSTRACT

A reflective base assembly for a performance stage lamp includes a base with a first pair of opposite sides and a second pair of opposite sides, a first pair of reflective mirrors respectively extending from the first pair of opposite sides of the base and meeting at a position above the base, a second pair of reflective mirrors respectively extending from the second pair of opposite sides of the base and meeting at a position above the meeting position of the first pair of reflective mirrors, and a pair of filter lenses respectively extending from the first pair of opposite sides of the base and meeting at a position above the meeting position of the second pair of reflective mirrors.

3 Claims, 5 Drawing Sheets

REFLECTING BASE ASSEMBLY FOR PERFORMANCE STAGE LAMPS

BACKGROUND OF THE INVENTION

1. Field of the Invention

The present invention relates to an improved reflecting base assembly for performance stage lamps and, more particularly, to an improved reflective base assembly which provides variable reflection angles and colors.

2. Description of Related Art

Lamps play an important role in stage performances, shows, television programs, and other places, such as dance halls, etc. Especially in dance halls, lamps which project kaleidoscopic colors particularly attract young people to enjoy dancing. Various attempts have been made to provide a lamp with more attractive kaleidoscopic colors but the shortcomings of these are readily apparent when one considers the loss of energy and the limitation of the number of holes in the pattern disc which controls the output colors.

Therefore, there has been a long and unfulfilled need for an improved performance stage lamp to mitigate and/or obviate the above-mentioned drawbacks.

SUMMARY OF THE INVENTION

The present invention provides a reflective base assembly mounted in an open reflective section of a performance stage lamp.

In accordance with a first embodiment of the present invention, the reflective base assembly includes a base with a first pair of opposite sides and a second pair of opposite sides, a first pair of reflective mirrors respectively extending from the first pair of opposite sides of the base and meeting at a position above the base, a second pair of reflective mirrors respectively extending from the second pair of opposite sides of the base and meeting at a position above the meeting position of the first pair of reflective mirrors, and a pair of filter lens respectively extending from the first pair of opposite sides of the base and meeting at a position above the meeting position of the second pair of reflective mirrors.

In accordance with a second embodiment of the present invention, the reflective base assembly includes a base with a first pair of opposite sides and a second pair of opposite sides, four reflective mirrors mounted to the base and forming a substantially pyramid-like structure, and a pair of filter lens respectively extending from the first pair of opposite sides of the base and meeting at a position above the pyramid-like structure.

In accordance with a third embodiment of the present invention, the reflective base assembly includes a base with a first pair of opposite sides and a second pair of opposite sides, a first pair of reflective mirrors respectively extending from the first pair of opposite sides of the base and meeting at a position above the base, a second pair of reflective mirrors respectively extending from the second pair of opposite sides of the base and meeting at a position above the meeting position of the first pair of reflective mirrors, a third pair of reflective mirrors respectively extending from the first pair of opposite sides of the base and meeting at a position above the meeting position of the second pair of reflective mirrors, and a pair of filter lens respectively extending from the second pair of opposite sides of the base and meeting at a position above the meeting position of the third pair of reflective mirrors.

According to the arrangement of the present invention, the reflected light beams are more kaleidoscopic than prior art.

Other objects, advantages, and novel features of the invention will become more apparent from the following detailed description when taken in conjunction with the accompanying drawings.

DESCRIPTION OF THE PREFERRED EMBODIMENTS

Figure 8:
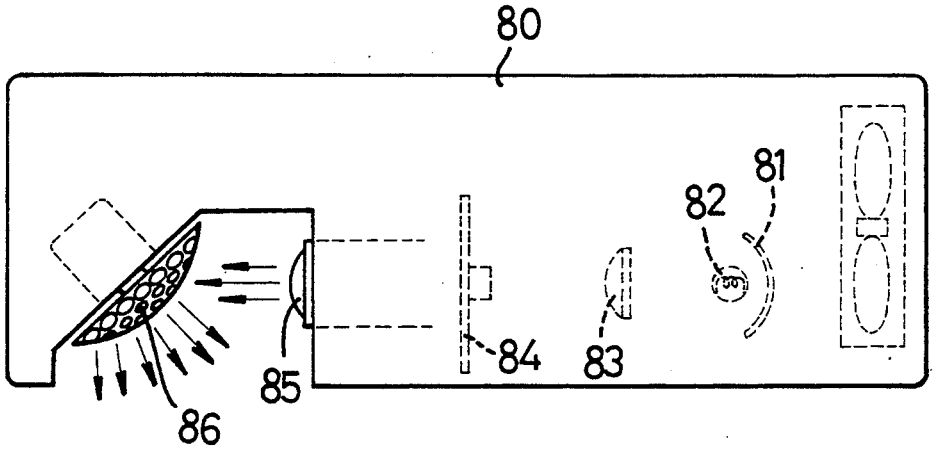
FIG. 8 PRIOR ART
FIG. 8 is a schematic top plan view of a conventional performance stage lamp.

For a better understanding of the background of the invention, reference is firstly made to FIG. 8 which illustrates a prior art performance stage lamp. As shown in this figure, a conventional performance stage lamp generally includes a housing 80 in which a reflection mirror 81, a light source 82, a light source lens 83, a pattern disc 84, a projecting lens 85, and a reflective base 86 are mounted. Light beams emitted by the light source 82, after being reflected by the reflection mirror 81 and subsequent passing through the light source lens 83 and the projecting lens 85, form light beams with different wavelengths and are then reflected by the reflective base 86, while the pattern disc 84 colors the light beams which pass therethrough. The pattern disc 84 includes a plurality of cutouts with different patterns and each of which is covered by a sheet with a different color. Thus, the reflected light beams have different reflection angles and colors.

The above-described design, however, causes a loss in light energy as part of a white light beam is filtered when it is transmitted or is reflected by a color sheet, thus the brightness of the reflected or transmitted light beam is reduced. Moreover, the colors of the reflective light beams are limited by the number of the cutouts with specific patterns in the pattern disc, i.e., the reflective color is the color of the sheet which covers the cutout through which the incident light beam passes.

Figure 1:
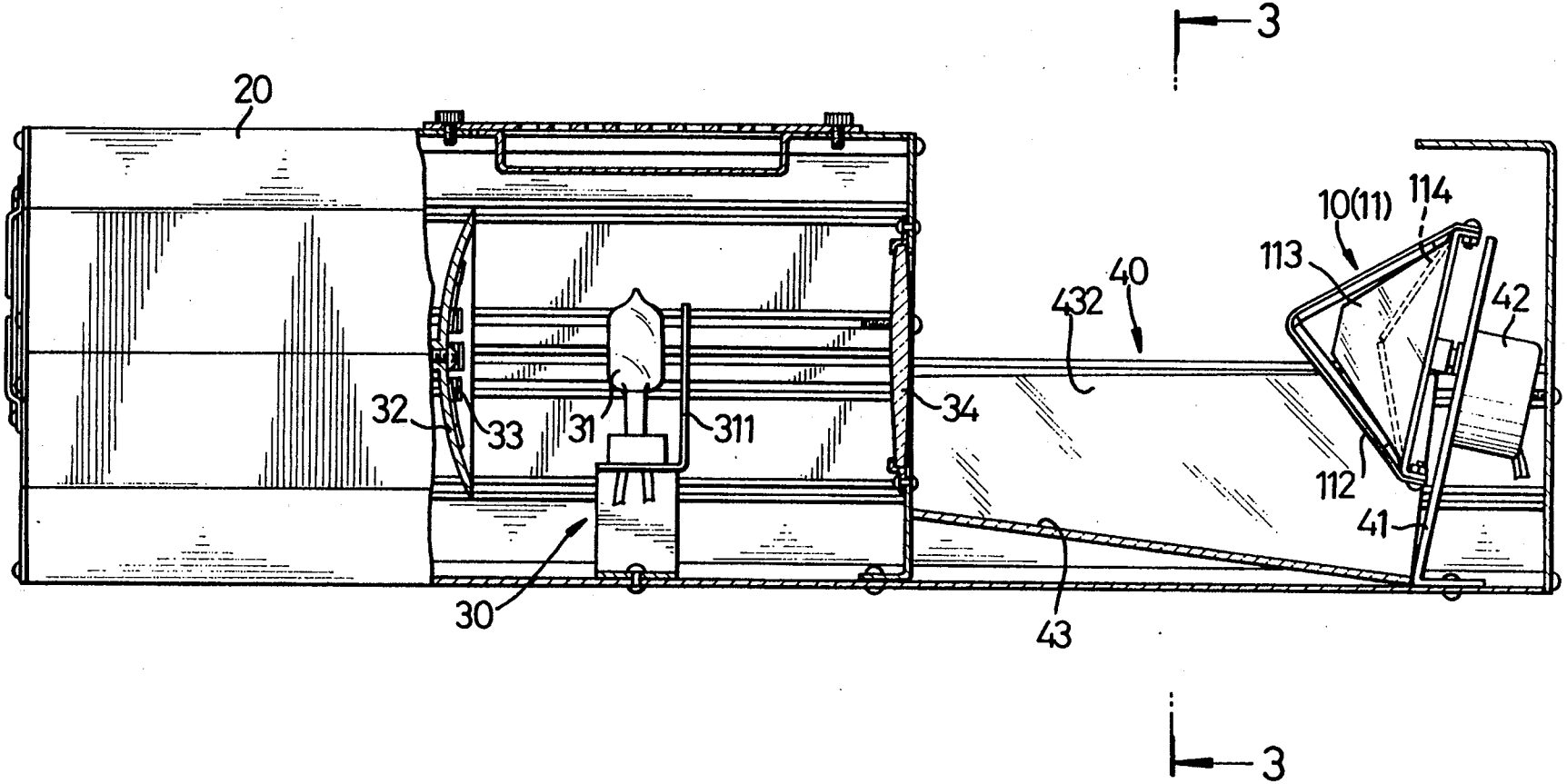
FIG. 1 is a side elevational view, partly in section, of a performance stage lamp which incorporates a first embodiment of a reflective base assembly in accordance with the present invention.

Referring now to FIG. 1, a reflective base assembly in accordance with the present invention is designated by reference numeral "10" and is mounted in a lamp housing 20 in which a projecting means 30 is mounted. The projecting means 30 includes a light source 31, a shield 311 mounted adjacent to an outer side of the light source 31, and an arcuate reflection member 32 mounted adjacent to an inner side of the light source, a plurality of small mirrors 33 being adhered to a surface of the reflection member 32. A convex projecting lens 34 is mounted in the housing 20 at a side opposite to the reflective mirror 32.

Figure 3:
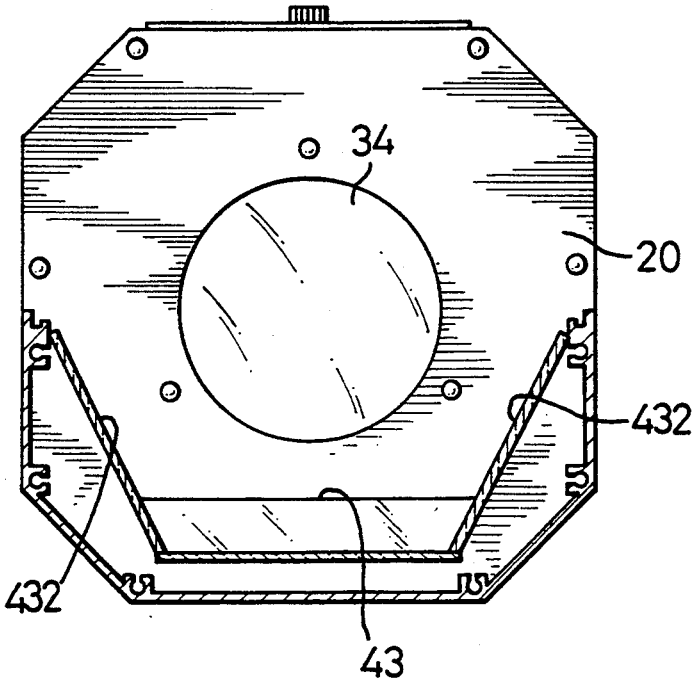
FIG. 3 is a cross-sectional view taken along line 3—3 in FIG. 1.

The housing 20 further includes an open, reflective section 40 for mounting a slant plate 41 to which the reflective base assembly 10 is mounted. A power source, such as a sound controlled motor 42, is mounted to the slant plate 41 to control rotation of the reflective base assembly 10. A reflective mirror 43 is slantingly mounted to a bottom of the reflective section 40 of the housing 20 with a mirror face thereof facing the reflective base assembly 10. Referring to FIG. 3, a pair of side mirrors 432 are also slantingly mounted in the reflective section 40 and respectively attached to two sides of mirror 43. Arrangement of the mirrors 43 and 432 is an auxiliary design to make the reflected light beams more kaleidoscopic.

Figure 2:
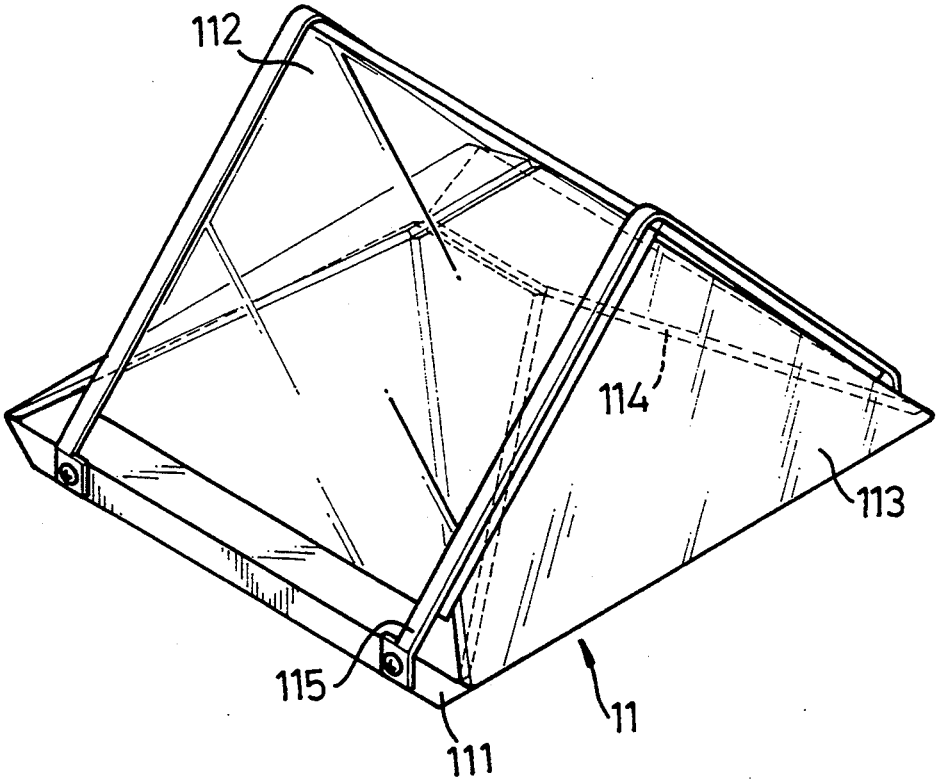
FIG. 2 is a perspective view of the reflective base assembly in FIG. 1.

Referring to FIG. 1 and further to FIG. 2, the reflective base assembly 10 provided by the present invention includes a reflective base 11 having a base 111 and three layers of mirror means mounted above the base 111. The first layer of mirror means includes a pair of slant trapezoid reflective mirrors 114 which respectively extend from two opposite sides of the base 111 and meet at a position substantially above a middle of the base 111. The second layer of mirror means includes a second pair of slant trapezoid reflective mirrors 113 which respectively extend from the other two opposite sides of the base 111 and meet at a position above the top of the first-mentioned slant trapezoid reflective mirrors 114. The third layer of mirror means includes a pair of slanted rectangular filter lenses 112 which respectively extend from the first-mentioned two opposite sides of the base 111 and meet at a position above the top of the second slanted trapezoid reflective mirrors 113. Braces 115 are provided to fix the filter lenses 112 to the base 111. It is appreciated that the area of the slant rectangular filter lenses 112 covers the areas of the first and second slant trapezoid reflective mirrors 114 and 113.

Figure 6:
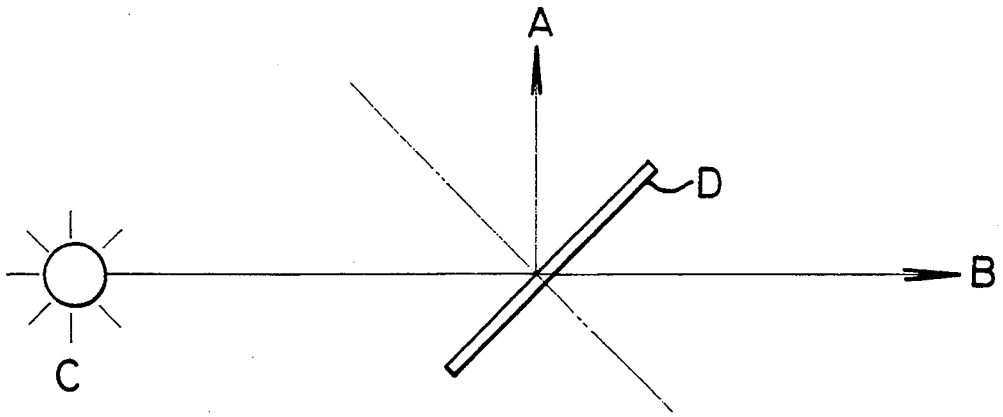
FIG. 6 is a schematic illustration of typical operation of a filtering lens.

Referring to FIG. 6, a white light beam C incident upon a filter lens D will generate a monochromatic transmission beam B and a reflective beam A with another color, the colors of the reflective beam A and transmission beam B depend on the inclination angle of the filter lens D.

Figure 7:
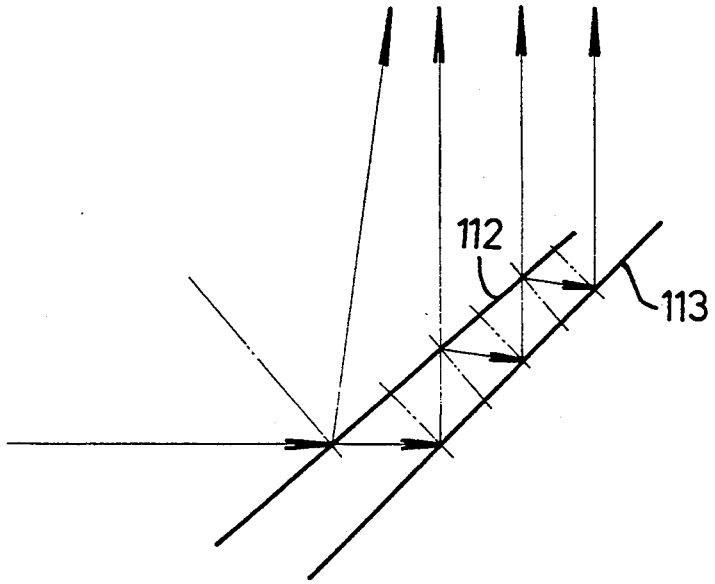
FIG. 7 is a schematic illustration of operation of the filter lens and reflective mirror of the reflective base assembly in FIG. 2.

Referring now to FIG. 7, a white light beam incident upon the filter lens 112 generates a reflective beam and a transmission beam which is reflected by a reflective mirror and which thus generates a transmission beam and a reflective beam which is reflected by the rear side of the filter lens 112 and again incident upon the second reflective mirror 113 or the first reflective mirror 114, depending on the incident orientation. Since the reflective base assembly 10 rotates during operation, .the incident angle varies at any time and thus produces kaleidoscopic reflective beams (the reasons of which have been described in the above paragraph) while the loss of energy is largely reduced.

Figure 4:
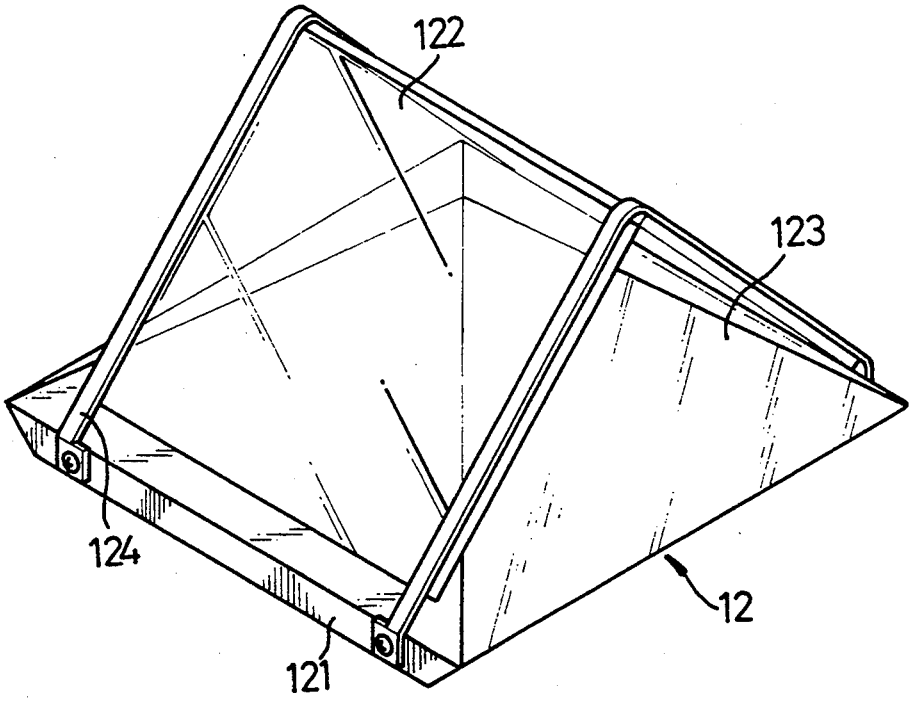
FIG. 4 is a perspective view showing a second embodiment of a reflective base assembly in accordance with the present invention.

FIG. 4 shows a second embodiment of the reflective base assembly which includes a reflective base 12 having a base 121, four reflective mirrors which constitute a substantially quadrilateral pyramid-like reflective mirror means 123, and a pair of slanted rectangular filter lenses 122 which respectively extend from two opposite sides of the base 121 and meet at a position above the top apex of the reflective mirrors means 123. Braces 124 are provided to fix the filter lens 122 to the base 121.

Figure 5:
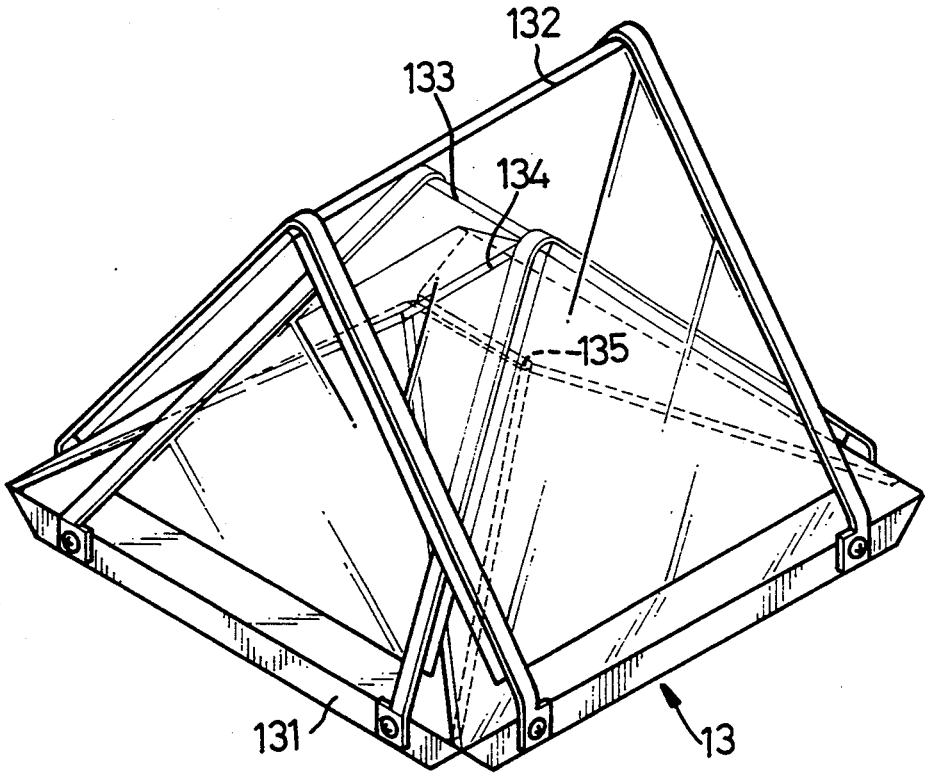
FIG 5 is a perspective view showing a third embodiment of a reflective base assembly in accordance with the present invention.

FIG. 5 shows a third embodiment of the reflective base assembly which includes a reflective base 13 having a base 131, first, second, and third layers of reflecting mirrors 135, 134, and 133, and a pair of rectangular slanted filter lenses 132 which are arranged in a manner similar to that in the first embodiment and is therefore not redundantly described.

According to the above description, it is appreciated that, when compared with prior art, the reflective base assembly provides a more kaleidoscopic reflective beams and minimizes the energy loss of the light beams.

Although the invention has been explained in relation to its preferred embodiment, it is to be understood that many other possible modifications and variations can be made without departing from the spirit and scope of the invention as hereinafter claimed.

I claim:

1. A reflective base assembly for a performance stage lamp of the type having a housing in which a projecting means is mounted and an open reflective section, said reflective base assembly being mounted in said reflective section and comprising:

a base with a first pair of opposite sides and a second pair of opposite sides;

a first pair of reflective mirrors respectively extending from said first pair of opposite sides of said base and meeting at a position above said base;

a second pair of reflective mirrors respectively extending from said second pair of opposite sides of said base and meeting at a position above said meeting position of said first pair of reflective mirrors; and a pair of filter lenses respectively extending from said first pair of opposite sides of said base and meeting at a position above said meeting position of said second pair of reflective mirrors.

2. A reflective base assembly for a performance stage lamp of the type having a housing in which a projecting means is mounted and an open reflective section, said reflective base assembly being mounted in said reflective section and comprising:

a base with a first pair of opposite sides and a second pair of opposite sides;

four reflective mirrors mounted to said base and forming a substantially pyramid-like structure; and a pair of filter lenses respectively extending from said first pair of opposite sides of said base and meeting at a position above said pyramid-like structure.

3. A reflective base assembly for a performance stage lamp of the type having a housing in which a projecting means is mounted and an open reflective section, said reflective base assembly being mounted in said reflective section and comprising:

a base with a first pair of opposite sides and a second pair of opposite sides;

a first pair of reflective mirrors respectively extending from said first pair of opposite sides of said base and meeting at a position above said base;

a second pair of reflective mirrors respectively extending from said second pair of opposite sides of said base and meeting at a position above said meeting position of said first pair of reflective mirrors;

a third pair of reflective mirrors respectively extending from said first pair of opposite sides of said base and meeting at a position above said meeting position of said second pair of reflective mirrors; and a pair of filter lenses respectively extending from said second pair of opposite sides of said base and meeting at a position above said meeting position of said third pair of reflective mirrors.

* * * * *